United States Patent [19]

Poulas

[11] Patent Number: 4,919,417

[45] Date of Patent: Apr. 24, 1990

[54] LIQUID FILLED JUMP ROPE

[76] Inventor: Peter W. Poulas, 59 Bozarthtown Rd., Tabernacle, N.J. 08088

[21] Appl. No.: 231,947

[22] Filed: Aug. 15, 1988

[51] Int. Cl.[5] ..... A63B 5/20

[52] U.S. Cl. ..... 272/75

[58] Field of Search ..... 272/74, 75, DIG. 9, 272/1 B, 71, 117, 124, DIG. 4

[56] References Cited

U.S. PATENT DOCUMENTS

| | | | |
|---|---|---|---|
| 4,079,932 | 3/1978 | Schuetz | 272/75 |
| 4,505,474 | 3/1985 | Mattox | 272/75 |
| 4,529,193 | 7/1985 | Kuhnsmon | 272/75 |

FOREIGN PATENT DOCUMENTS

| | | | |
|---|---|---|---|
| 8801522 | 3/1988 | World Int. Prop. O. | 272/75 |

*Primary Examiner*—Stephen R. Crow

*Attorney, Agent, or Firm*—Panitch Schwarze Jacobs & Nadel

[57] ABSTRACT

The invention is a jump rope comprising an elongate flexible tube of liquid impervious material, a quantity of water in the tube, an end closure sealing each end of the tube, and a handle surrounding each tube end and interfitting with the adjacent end closure for securement of the received tube end.

3 Claims, 1 Drawing Sheet

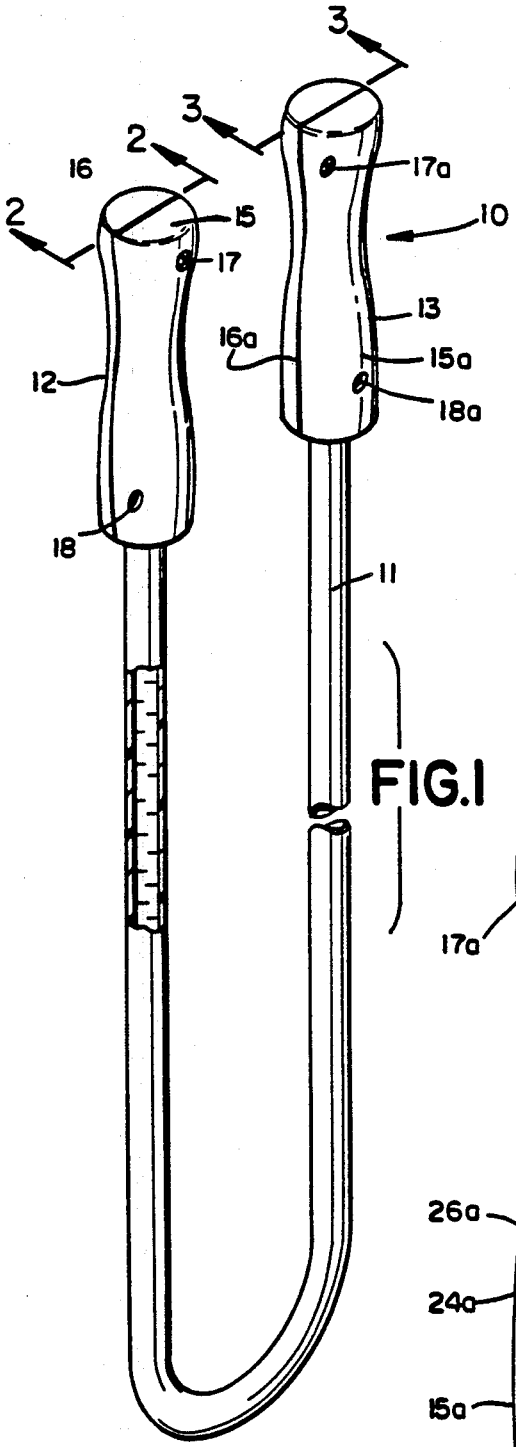
FIG.1
FIG.2
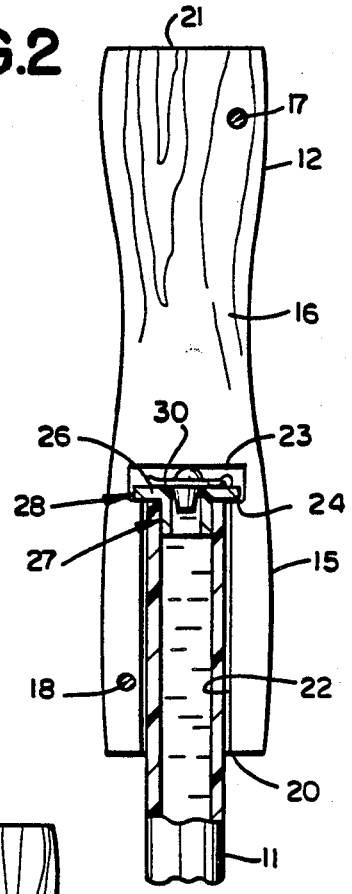
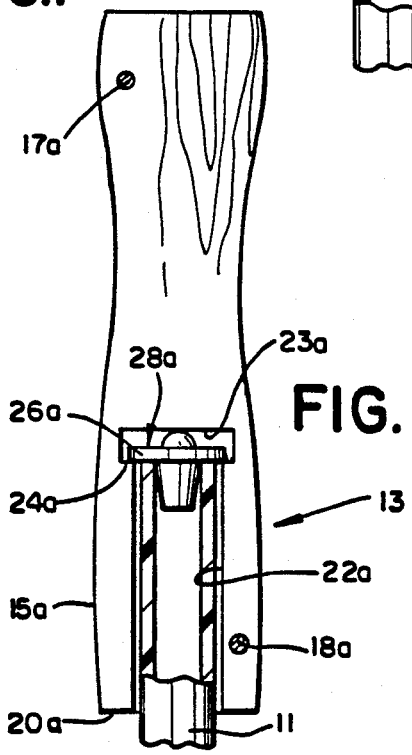
FIG. 3

LIQUID FILLED JUMP ROPE

BACKGROUND OF THE INVENTION

Applicant is aware of the below listed prior patents:

| NAME | U.S. Pat. No. | DATE |
|---|---|---|
| FEINN | 3,064,972 | NOV. 20, 1962 |
| SPOCZYNSKI | 3,212,777 | OCT. 19, 1965 |
| MATTOX | 4,505,474 | MAR. 19, 1985 |

The prior patents found do not suggest weighting a jump rope with water, nor with provision for varying the quantity of water, nor with tube end closures interfitting with hand grips and the provision of means for adding or removing water, as desired.

SUMMARY OF THE INVENTION

It is an important object of the present invention to provide a jump rope wherein a flexible tube, say of transparent plastic, is filled to a desired extent with water, the tube ends sealed, and hand grips provided on opposite ends of the tube for operating the jump rope.

It is a further object of the present invention to provide a jump rope of flexible tubing containing water, and handles secured to opposite ends of the tubing, one end of the tubing being provided with an openable closure for adding and removing water with respect to the tube.

DESCRIPTION OF THE PREFERRED EMBODIMENTS

It is among the further objects of the present invention to provide a jump rope which can vary between being highly aerobic, being relatively light in weight, for firming of the body without producing excessive muscle size. Indeed, the same jump rope employed for upper body work out for men may, by removing liquid be satisfactory for use by children.

The jump rope of the present invention includes a flexible plastic tube, preferably transparent, or which may glow in the dark and assume various colors, as by food coloring in the liquid.

A further object of the present invention resides in the provision of a jump rope which is entirely safe, as water will not injure, even if the tube is damaged.

A further object resides in the provision of a jump rope which is readily collapsible, or folded and rolled, to occupy a minimum of space when not in use, as by removal of the contained liquid.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is a perspective view showing a jump rope constructed in accordance with the teachings of the present invention.

FIG. 2 is a longitudinal sectional view taken generally along the line 2—2 of FIG. 1.

FIG. 3 is a longitudinal sectional view taken generally along the line 3—3 of FIG. 1.

DESCRIPTION OF THE PREFERRED EMBODIMENT

Referring now more particularly to the drawings, and specifically to FIG. 1 thereof, a jump rope is there generally designated 10, and generally includes a rope portion or tube 11 provided at its opposite ends with hand holds or handles, as at 12 and 13.

The elongate flexible element, tube or rope 11 is advantageously fabricated of a flexible liquid impervious, transparent plastic tubing, such as vinyl or other suitable plastic material.

The grip or handle 12 includes a pair of complementary longitudinally extending side members or pieces 15 and 16. The handle side members or parts 15 and 16 are detachably secured together by suitable fastener means, such as 13 and 18 extending transversely through the parts. Of course, other securing means may be employed, if desired.

The handle side member 15 is substantially identical to the side member 16, so that a detailed description of one side member will suffice.

The handle 12 includes an inner end 20, and an outer end 21. A bore or hole 22 extends longitudinally inwardly of the handle 12 from the inner end 20, generally coaxially of the handle. The bore 22 extends a substantial distance inwardly being generally cylindrical in configuration. and terminates in an enlarged, generally cylindrical chamber or cavity 23, proximate to and spaced inwardly from the handle end 21. The cylindrical bore 20 may enter coaxially into the enlarged chamber 23, the chamber providing a generally annular shoulder 24 facing inwardly of the bore toward the handle end 21.

The handle side 15 is substantially the same as the handle side member 16. The handle side members 15 and 16 are complementary or congruent, each having a semi-cylindrical recess, as at 22, which combine to define the cylindrical bore, and a semi-cylindrical enlarged recess at the inner end, which combine to define the chamber 23.

The tube 11 has one end 27 extending inwardly of the bore 22 proximate to the chamber 23. An end closure is provided by a hollow plug 28 is inserted snugly into the tube end 27, and suitably sealed therein, as by adhesive, friction, or other, and includes a transverse projection or lip 26 constituting a flange of the end closure extending laterally beyond the bore 22 for seating engagement on the inwardly facing shoulder 24. Also, the plug 28 is provided with an openable closure 30 for access to the interior of the tube 11, as in introducing or removing liquid from the tube.

The handle 13 includes a pair of generally congruent, or complementary side pieces **15*a* and 16*a* removably secured together by fasteners 17*a* and 18*a*. The side piece 15*a* includes a semi-cylindrical, longitudinally extending recesses combining to define a longitudinal bore 22*a* which extends inwardly from the lower end 20*a* of the handle 13 to an internally enlarged cavity or chamber 23*a*. The chamber provides a shoulder 24*a*, and the tube 11 extends inwardly of the bore 22*a* into the chamber 23*a* where it is closed and sealed with another end closure in the form of a plug 28*a* having a lip constituting a flange 26*a* of the end closure 28*a* in retaining abutting engagement with the shoulder 24*a***.

Of course, with the side pieces secured together in their complementary relation, a user may grasp the handles and use the jump rope in a conventional manner. If it is desired to alter the amount of water in the tube 11, access may be had through the openable closure 30.

Although the present invention has been described in some detail by way of illustration and example for purposes of clarity of understanding, it is understood that certain changes and modifications may be made within the spirit of the invention.

What is claimed is:

1. A jump rope comprising an elongate flexible tube of liquid impervious material, a quantity of water in said tube, an end closure sealing each end of said tube, a handle surrounding each tube end and interfitting with the adjacent end closure for securement of the received tube end, each of said handles comprising an elongate body having a bore extending longitudinally inwardly from one end, said bores each receiving one end of said tube, each bore terminating at its inner end in an enlarged chamber with an inwardly facing shoulder, each end closure including a flange in abutting engagement with the inwardly facing shoulder for tube retention in said handles, each end closure comprising a plug secured in a respective end of said tube, each plug having a lip constituting the flange of the end closure in abutting engagement with the inwardly facing shoulder, access means on one of said handles for access to the adjacent end closure, valve means on said adjacent end closure for introducing and removing water with respect to said tube.

2. A jump rope according to claim 1, said handles each comprising a pair of longitudinally extending mating halves detachably secured together and detachable for affording access to said bores and tube ends.

3. A jump rope according to claim 1, wherein said water is colored and said tube being transparent for exposing the color of the water in the tube.

* * * * *